US006730051B2

(12) United States Patent
Lin

(10) Patent No.: US 6,730,051 B2
(45) Date of Patent: May 4, 2004

(54) ROTATING AND VIBRATING MASSAGE SHOWER NOZZLE

(76) Inventor: Chun-Kuang Lin, No. 17, Lane 765, Kuang-Shing Rd., Taiping City, Tai-Chung Hsien (TW)

( * ) Notice: Subject to any disclaimer, the term of this patent is extended or adjusted under 35 U.S.C. 154(b) by 208 days.

(21) Appl. No.: 10/056,624

(22) Filed: Jan. 28, 2002

(65) Prior Publication Data

US 2003/0144615 A1 Jul. 31, 2003

(51) Int. Cl.[7] ..... A61H 7/00; A61H 9/00

(52) U.S. Cl. ..... 601/112; 601/114; 601/155; 601/159; 601/160; 601/169; 15/29; 4/606

(58) Field of Search ..... 601/55, 69, 70, 601/72, 73, 75, 112, 113, 114, 154, 155, 159, 160, 161, 162, 165, 169; 15/22.1, 28, 29; 4/606, 570, 615; 401/163, 169, 280, 281; 239/243, 380, 525

(56) References Cited

U.S. PATENT DOCUMENTS 2,026,981 A * 1/1936 Kahn ..... 601/160
4,841,590 A * 6/1989 Terry et al. ..... 601/114
5,033,897 A * 7/1991 Chen ..... 401/281
5,385,532 A * 1/1995 Shyu ..... 601/160
5,647,841 A * 7/1997 Groenewold et al. ..... 601/114
5,893,836 A * 4/1999 Raines ..... 601/69
5,909,754 A * 6/1999 Oh ..... 15/29
6,041,462 A * 3/2000 Marques ..... 15/28
6,338,170 B1 * 1/2002 De Simone ..... 601/114

* cited by examiner

*Primary Examiner*—Nicholas D. Lucchesi
*Assistant Examiner*—Quang D Thanh
(74) *Attorney, Agent, or Firm*—Charles E. Baxley

(57) ABSTRACT

A rotating and vibrating massage shower nozzle comprised of a first transmission shaft and a flexible transmission cable. The first transmission shaft rotates a drive gear, a driven gear, and a second transmission shaft. The second transmission shaft has a drive ring gear installed on it that impels a bevel gear train or an eccentric cylinder, with the bevel gear train controlling the revolution of a rotary output coupling such that a bathing accessory mounted on it is spun and the imbalanced action of the eccentric cylinder effectively generates vibrations for massage applications.

17 Claims, 8 Drawing Sheets

ROTATING AND VIBRATING MASSAGE SHOWER NOZZLE

BACKGROUND OF THE INVENTION

1) Field of the Invention

The invention herein relates to handheld shower nozzles utilized for bathing, specifically a rotating and vibrating massage shower nozzle equipped with an interchangeable brush head, massage head, or other accessory attachment and that is capable of being switched between rotation and vibration modes.

2) Description of the Prior Art

Conventional shower nozzles are typically capable of only converting tap water into a cascading drizzle, with the user turning a control on the shower nozzle to adjust the flow intensity as required. Many manufacturers have equipped such shower nozzles with massage capability, but it is commonly known that there are limits as to how much massage performance is achievable and, furthermore, water is wasted in the process.

SUMMARY OF THE INVENTION

The primary objective of the invention herein is to provide a rotating and vibrating massage shower nozzle in which a bathing accessory (such as a brush or massage head) can be interchangeably attached to the shower nozzle and, furthermore, the shower nozzle is capable of controlling the rotation or vibration of the said bathing accessory to effectively achieve cleaning, massaging, and the promotion of blood circulation.

To achieve the said objective, the technology applied includes:

A first transmission shaft and a flexible transmission cable; the said first transmission shaft sequentially rotates a drive gear, a driven gear, and a second transmission shaft; the said second transmission shaft has a drive ring gear installed on it that impels a bevel gear train or an eccentric cylinder, with the said bevel gear train controlling the revolution of a rotary output coupling such that the bathing accessory mounted on it is spun and the said imbalanced action of the eccentric cylinder effectively generates vibrations for massage applications.

DETAILED DESCRIPTION OF THE INVENTION

Figure 1:
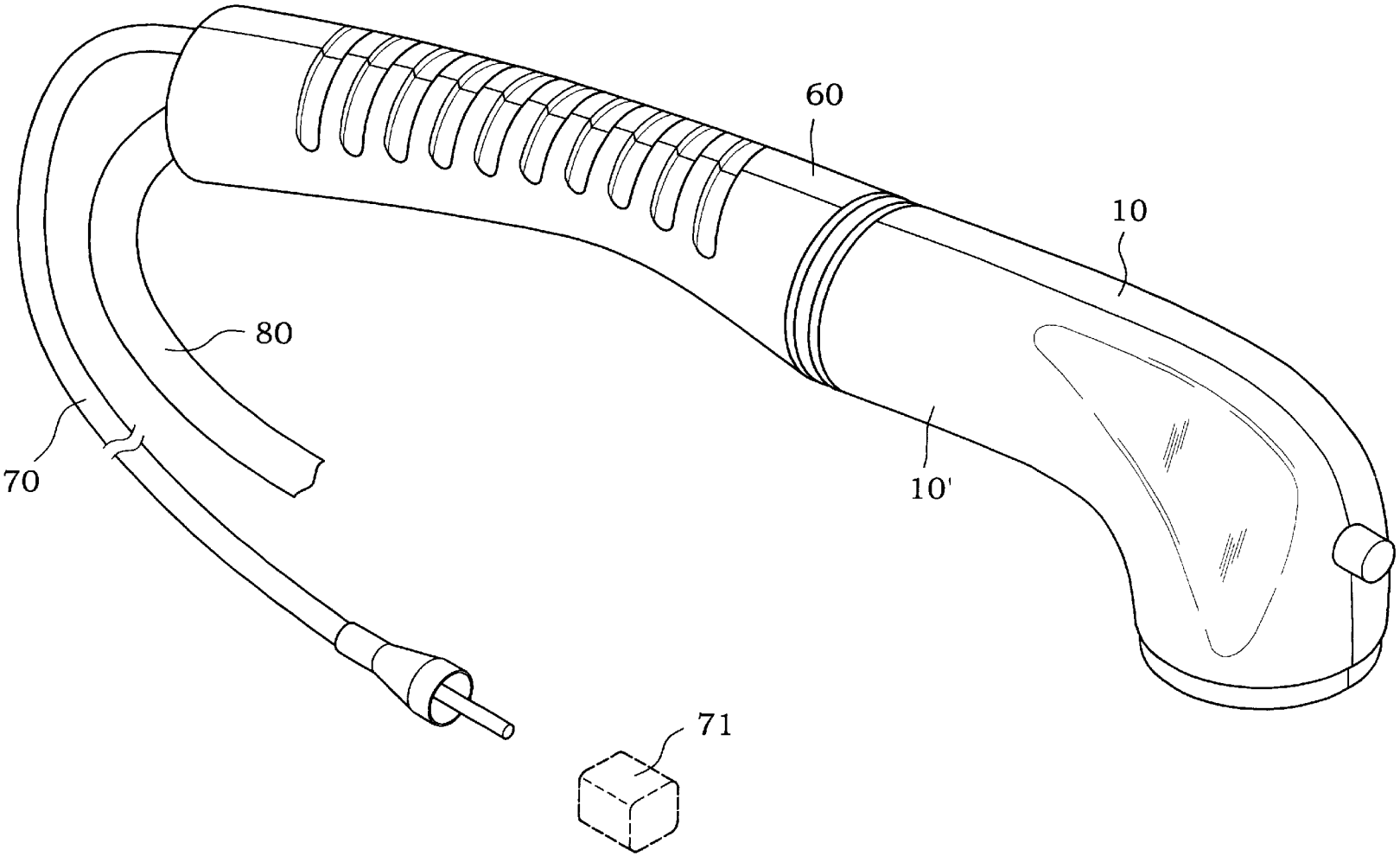
FIG. 1 is an isometric drawing of the invention herein.
Figure 2:
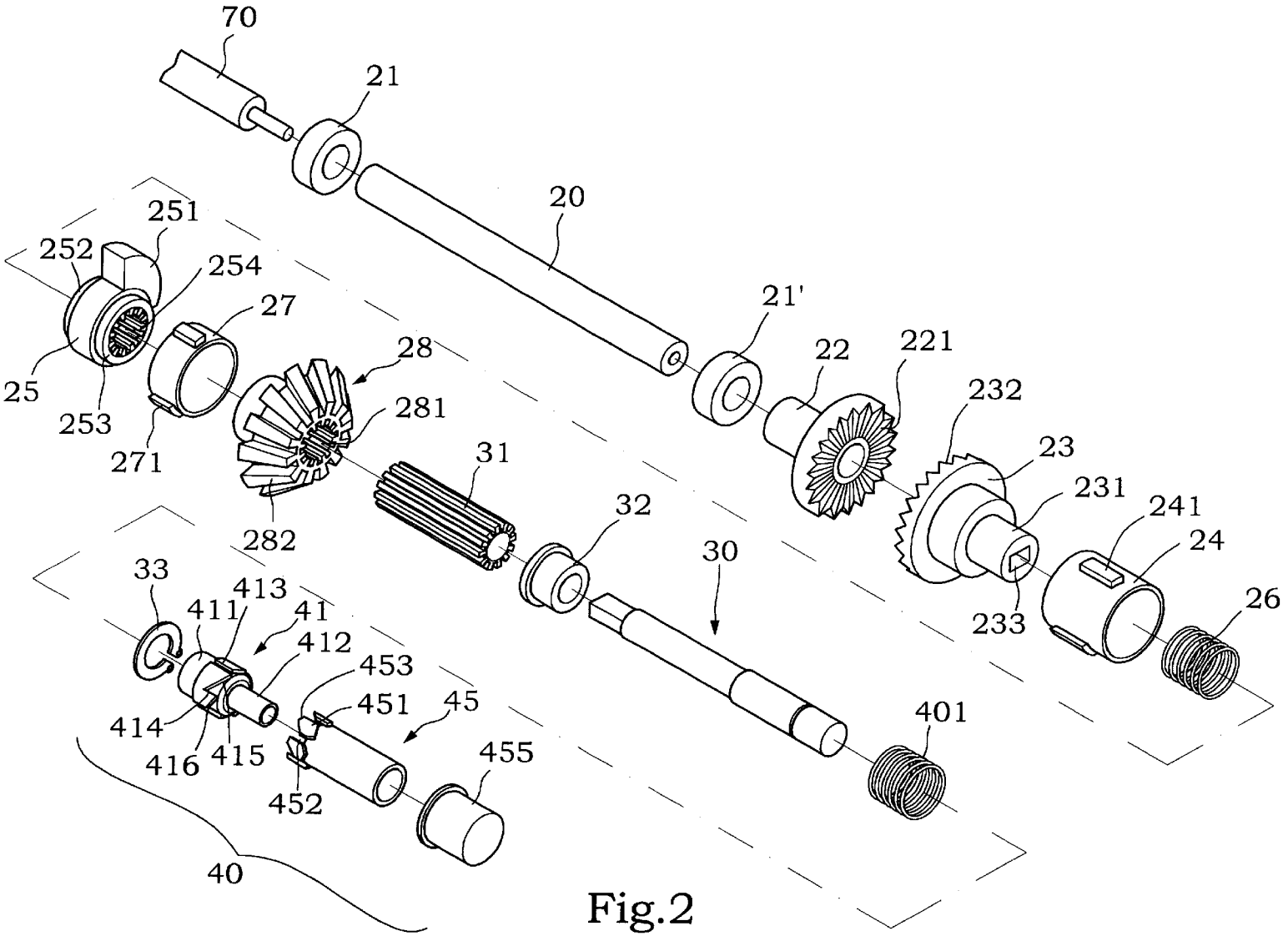
FIG. 2 is an exploded drawing of the invention herein.
Figure 3:
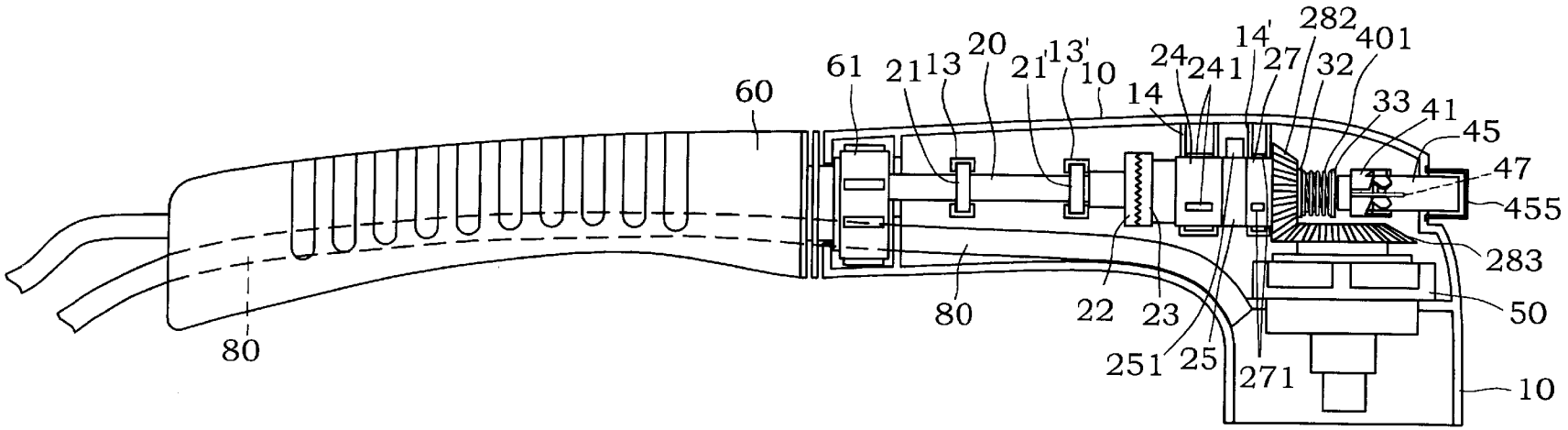
FIG. 3 is a cross-sectional drawing of the internal structure of the invention herein.
Figure 4:
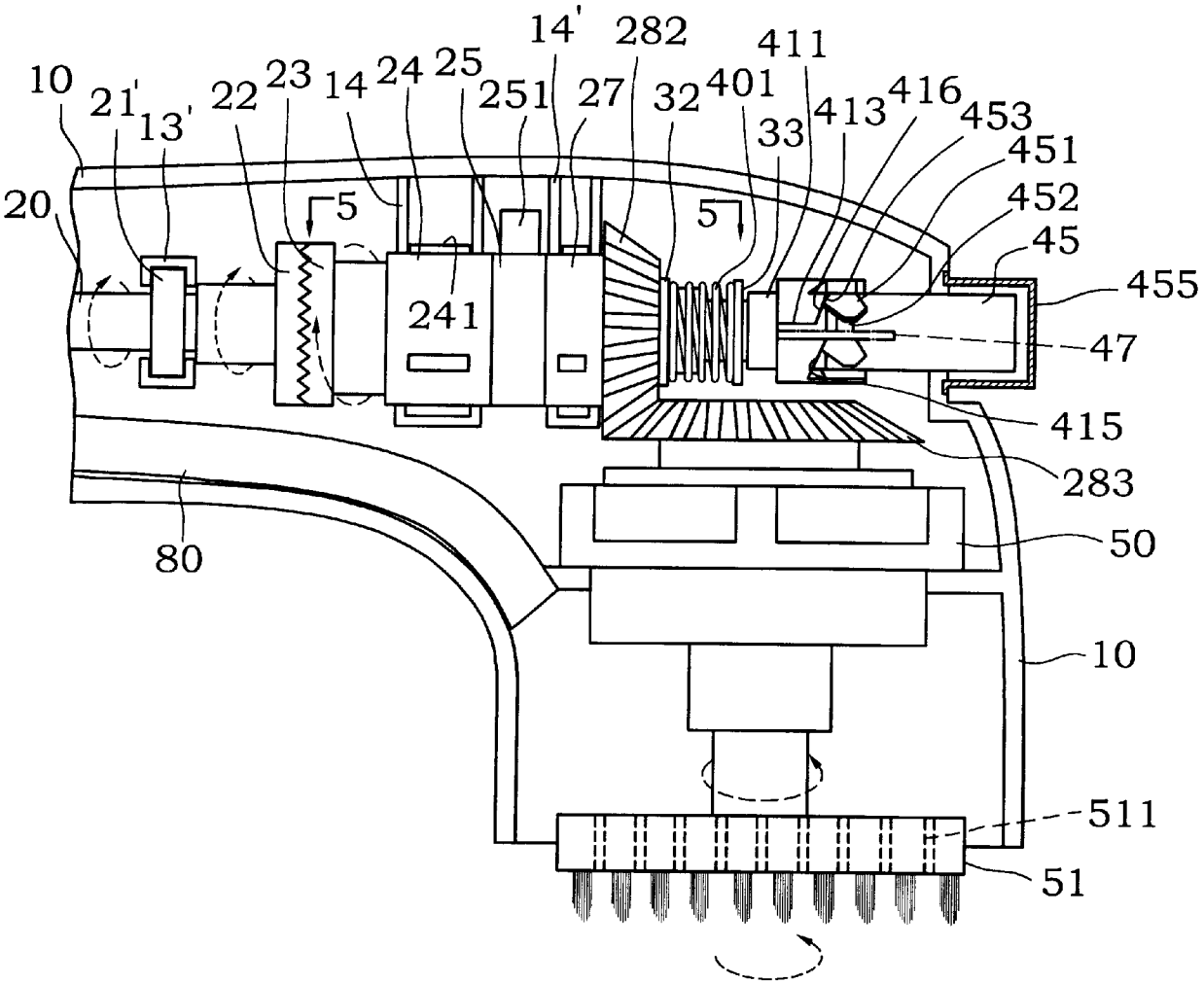
FIG. 4 is a cross-sectional drawing of the rotating shower nozzle structure.

Referring to FIG. 1, FIG. 2, FIG. 3, and FIG. 4, the invention herein is comprised of:

A first and a second case half 10 and 10' that are assembled together to form a hollow containment space.

A first transmission shaft 20 situated in the said containment space has two bearings 21 and 21' for balanced rotation, with the said two bearings 21 and 21' respectively seated in bearing mounts 13 and 13'.

A drive gear 22, one end of which is tightly sleeved onto the said first transmission shaft 20, with the other end consisting of a toothed surface 221.

A driven gear 23 having a stepped stem 231, with a toothed surface 232 at one end that is enmeshed with the toothed surface 221 of the said transmission shaft 20; and the said driven gear 23 has a rectangular hole 233 formed in its other end.

A first locating ring 24 consisting of a hollow annular structure having a plurality of projecting blocks 241 along its outer surface and that is fitted into a first ring mount 14, with the stem 231 of the said driven gear 23 inserted into the said first locating ring 24.

An eccentric cylinder 25 having a counterweight lobe 251 disposed on its outer surface as well as a first sleeve section 252 and a second sleeve section 253 at it two ends; the said first sleeve section 252 is inserted into the said first locating ring 24; and internal splines 254 are formed lengthwise along its interior.

A packing spring 26 having one end inserted into the stem 231 of the said driven gear 23 and the other end placed against the first sleeve section 252 of the said eccentric cylinder 25, and which is situated inside the said first locating ring 24.

A second locating ring 27 consisting of a hollow annular structure, one end of which accommodates the insertion of the second sleeve section 253 of the said eccentric cylinder 25, having a plurality of projecting blocks 271 along its outer surface that provides for fitting into a second ring mount 14' of the case.

A bevel gear train 28 consisting of a first gear 282 and a second gear 283; one end of the first gear 282 is inserted into the said second locating ring 27 and internal splines 281 are formed lengthwise along its interior; and the second gear 283 is enmeshed to the first gear 282.

A second transmission shaft 30, one end of which is inserted through the said first gear 282, second locating ring 27, eccentric cylinder 25, and first locating ring 24 and then snugged into the rectangular hole 233 of the said driven gear 23, with the said rectangular hole 233 having an appropriate depth that provides for the linear travel of the said second transmission shaft 30; the said second transmission shaft 30 is inserted into a drive ring gear 31 and the said drive ring gear 31 is enmeshed with the internal splines 281 inside a minimum of one said first gear 282; and the said second transmission shaft 30 has a stop collar 32 that mounts it to the end section of the said first gear 282.

A spring-loaded shifting mechanism 40 consisting of a spring 401, a transmission column 41, and a plunger column 45; the said spring 401 is situated such that it is against the said stop collar 32 and its other end is against a C-shaped clip ring 33 on the second transmission shaft 30.

The said transmission column 41 has a tubular extremity 411 of reduced diameter at one end that provides for insertion into and against the end section of the second transmission shaft 30, enabling the transmission column 41 to linearly push the said second transmission shaft 30, but remain capable of free rotation at the shaft end section; the said transmission column 41 has a rod-like tip 412 of a narrowed diameter extending from its other end that is inserted into the said plunger column 45; the said transmission column 41 has a plurality of guide slots 413 disposed along its outer periphery, a detent slot 414 of a bevel gear-profiled design situated between each guide slot 413, a first slanted edge 415, and a second slanted edge 416.

The plunger column 45 is crowned with a plurality of spurs 451 protruding at intervals that correspond to the end section of the said transmission column 41, a guide slot 452 is formed between each spur 451, and an angular slip actuation edge 453 is disposed on its open end; the other end of the plunger column 45 extends outside the said case halves 10 and 10 and is covered with a soft plastic cap 455.

The said shower nozzle case halves 10 and 10' have a plurality of internally protruding slide rails 47 that correspond to the guide slots 413 situated in the said spring-loaded shifting mechanism 40. When assembled, the guide slots 413 and 452 of the said transmission column 41 and plunger column 45 are set onto the said slide rails 47, at which time the first and second slanted edges 415 and 416 of the said transmission column 41 are respectively positioned against the slip actuation edge 453 of the said plunger column 45; the tensile force of the said spring 401 exerted against the second transmission shaft 30 is transferred to the said transmission column 41 and plunger column 45 such that the plunger column 45 end section is pushed out of the case halves 10 and 10'.

Figure 5:
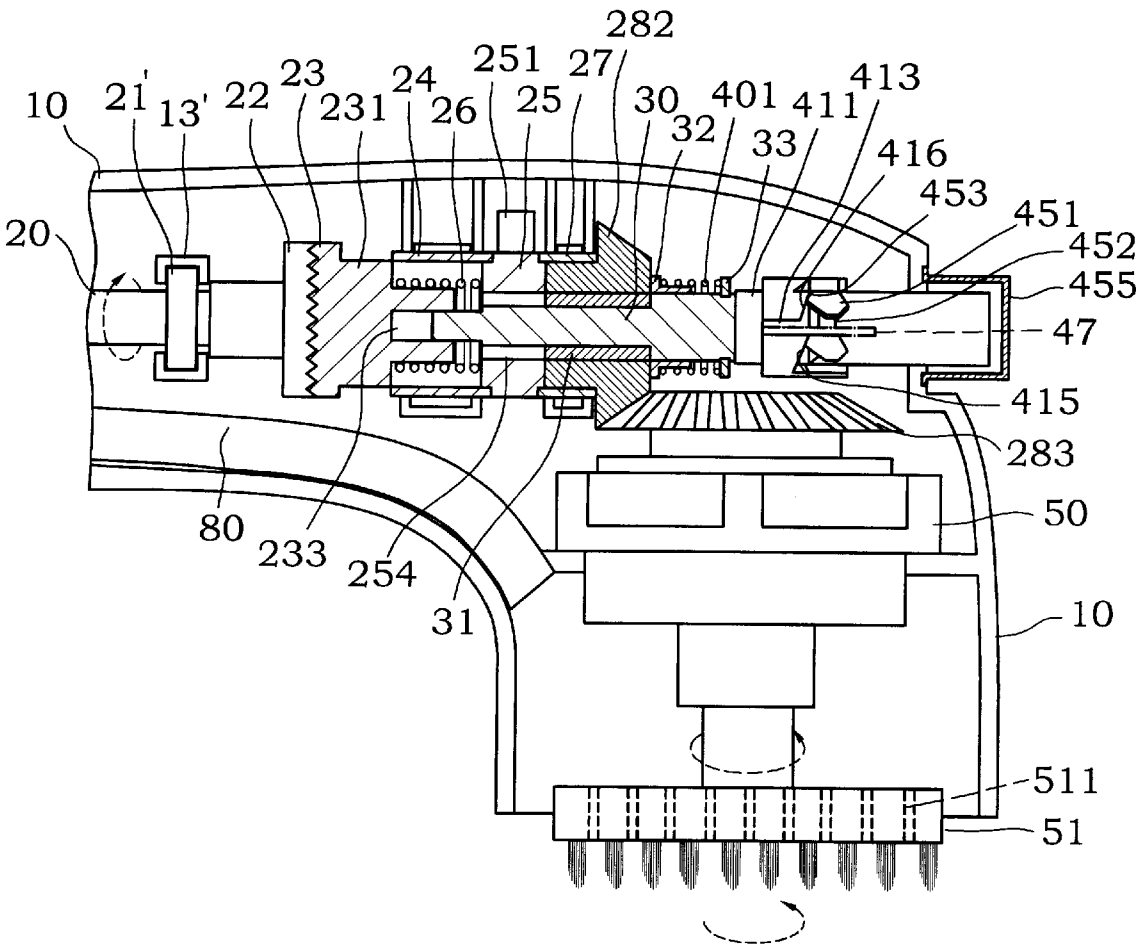
FIG. 5 is a magnified cross-sectional drawing of FIG. 4 as viewed from the perspective of line 5—5.
Figure 6:
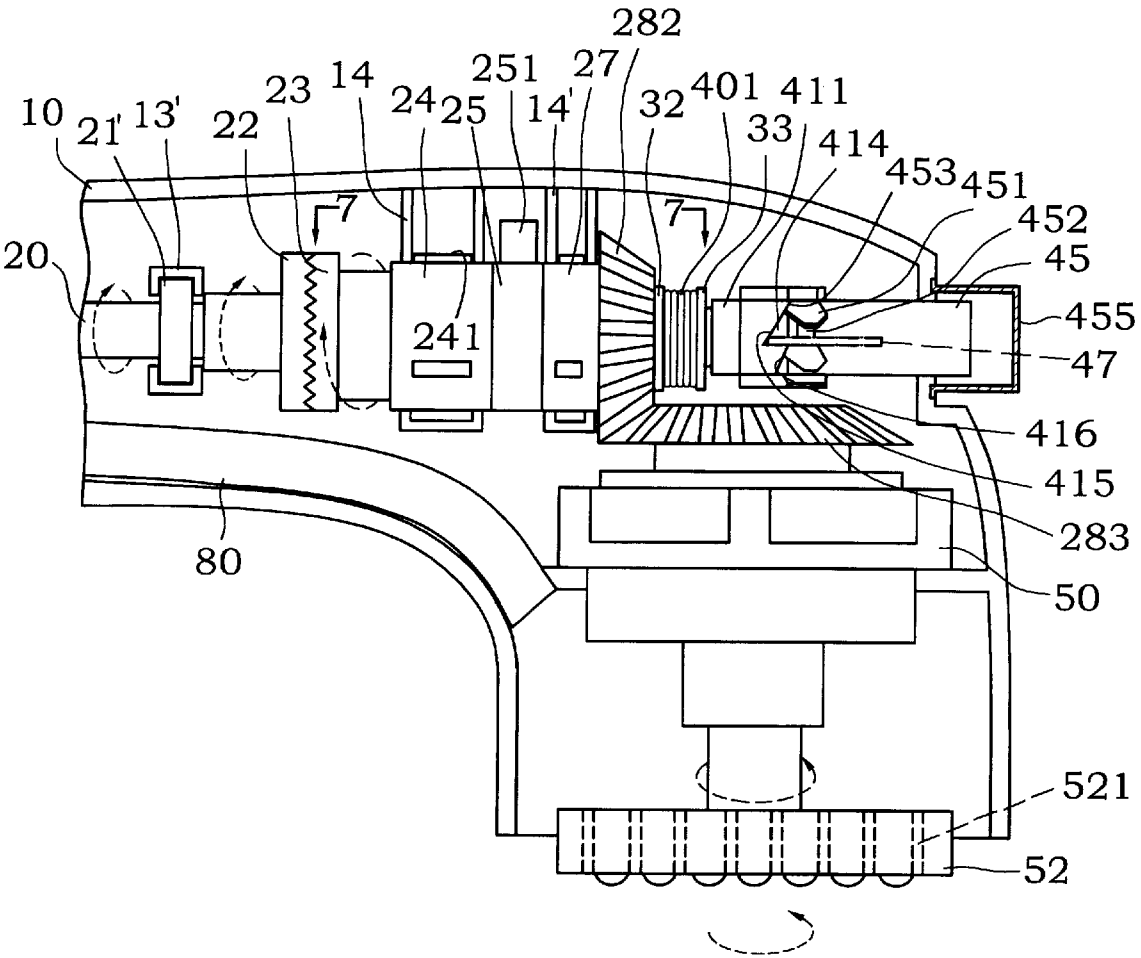
FIG. 6 is a cross-sectional drawing of the invention herein during rotation and vibration.
Figure 7:
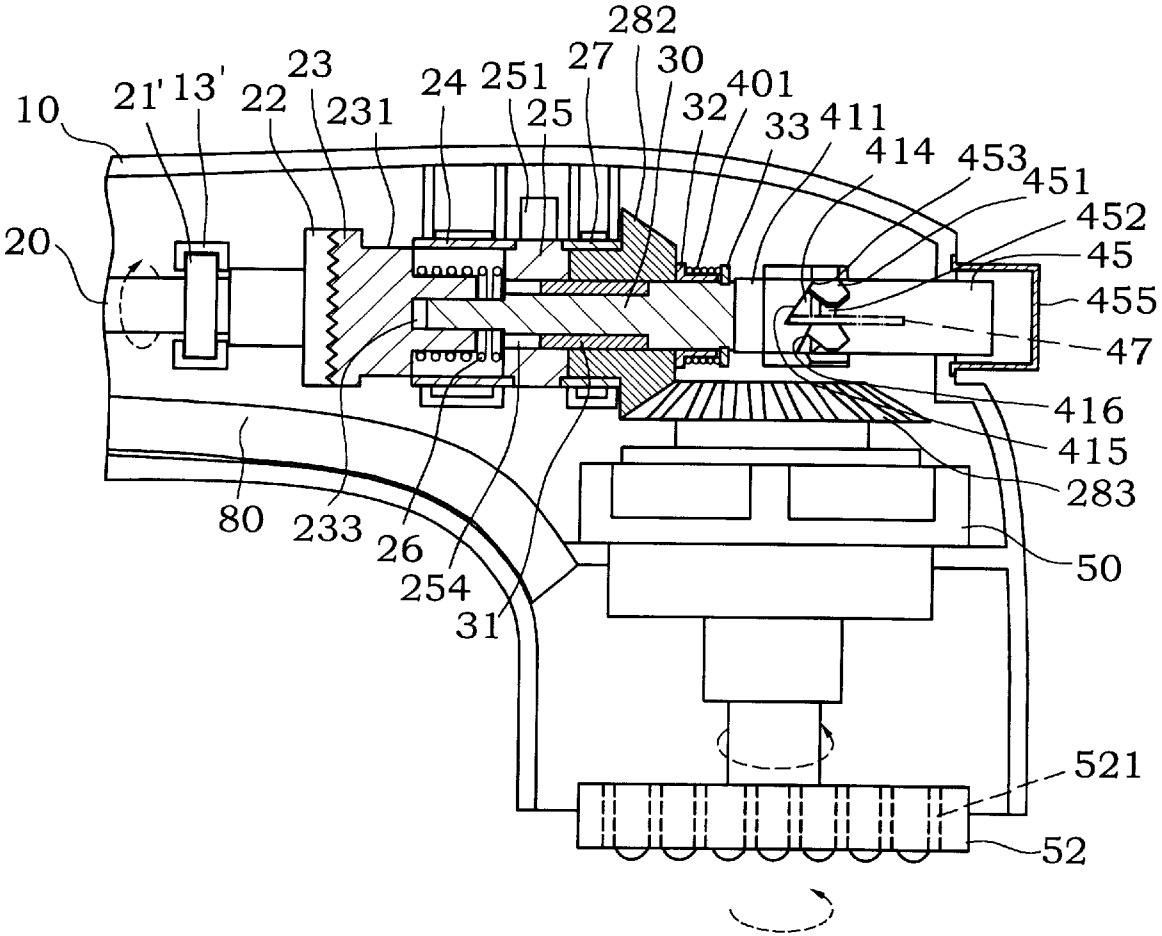
FIG. 7 is magnified, partial cross-sectional drawing of FIG. 6 as viewed from the perspective of line 7—7.

A rotary output coupling 50, one end of which is connected to the second gear 283 of the said bevel gear train 28, with a bathing accessory (such as a brush head 51 or a massage head 52) attached to its other end (as shown in FIG. 5, FIG. 6, and FIG. 7).

A handle 60, the end portion of which is sleeved in an elastomeric damper grip 61 that minimizes vibration.

A flexible transmission cable 70 having a soft protective lining on its exterior; one end of the said flexible transmission cable 70 is connected to a motor 71, while the other end is inserted through the said handle 60 and the said damper grip 61, and then conjoined to the said first transmission shaft 20.

A water hose 80, one end of which is attached to a water source, with the other end is inserted through the said handle 60 and the said damper grip 61 into the said rotary output coupling 50; after the faucet is opened, water immediately flows into the brush head 51 or massage head 52 attachment section and is discharged from the orifices 511 and 521.

As indicated in FIG. 6 and FIG. 7, when the user depresses the soft plastic cap 455 the plunger column 45 is moved inward, the transmission column 41 pushes the second transmission shaft 30, the second transmission shaft 30 compresses the spring 401 by means of its C-shaped clip ring 33, and the guide slots 413 the transmission column 41 travel along the slide rails 47; the first slanted edge 415, the second slanted edge 416, and the slip actuation edge 453 are articulated in a coordinated movement by their angular faces and the rebound tension of the spring 401, thereby causing the transmission column 41 to rotate until the slide rails 47 become engaged in the detent slots 414 and the second transmission shaft 30 is pushed inward and positioned such that a section of the drive ring gear 31 on it is enmeshed with the internal splines 281 of the first gear 282 and another section is enmeshed with the internal splines 254 of the eccentric cylinder 25. In this state, the motor 71 is switched on and the flexible transmission cable 70 rotates the first transmission shaft 20, drive gear 22, driven gear 23, and the second transmission shaft 30, with the drive ring gear 31 then causing the rotation of the first gear 282 and eccentric cylinder 25. At the same time, the first gear 282 rotates the second gear 283, rotary output coupling 50, and the brush head 51 or massage head 52, thereby enabling the brush head 51 or massage head 52 to spin and be used for cleansing. Due to the effect of the counterweight lobe 251 while the eccentric cylinder 25 is rotating, the shower nozzle structure vibrates to provide for massaging applications.

By depressing the plunger column 45 once again, the said plunger column 45 is pushed against the said transmission column 41 until the said detent slots 414 are disengaged from the said slide rails 47, the transmission column 41 rotates to the next guide slot 413 relative to the said slide rails 47, and the said second transmission shaft 30 pushes the said transmission column 41 along the said slide rails 47 as the said spring 401 is released, thereby enabling the end section of the plunger column 45 to extend outside the said case halves 10 and 10'; in this state, since the drive ring gear 31 of the second transmission shaft 30 recedes back and is disengaged from the internal splines 254 of the eccentric cylinder 25, and is only enmeshed with the first gear 282 and the internal splines 281 of the said bevel gear train 28, the first gear 282 of the bevel gear train 28 is rotated by the second transmission shaft 30 and the said second gear 283 rotates the said rotary output coupling 50 as well as the brush head 51 or massage head 52 attached to it, which is among the shower nozzle rotation modes of the invention herein.

Figure 8:
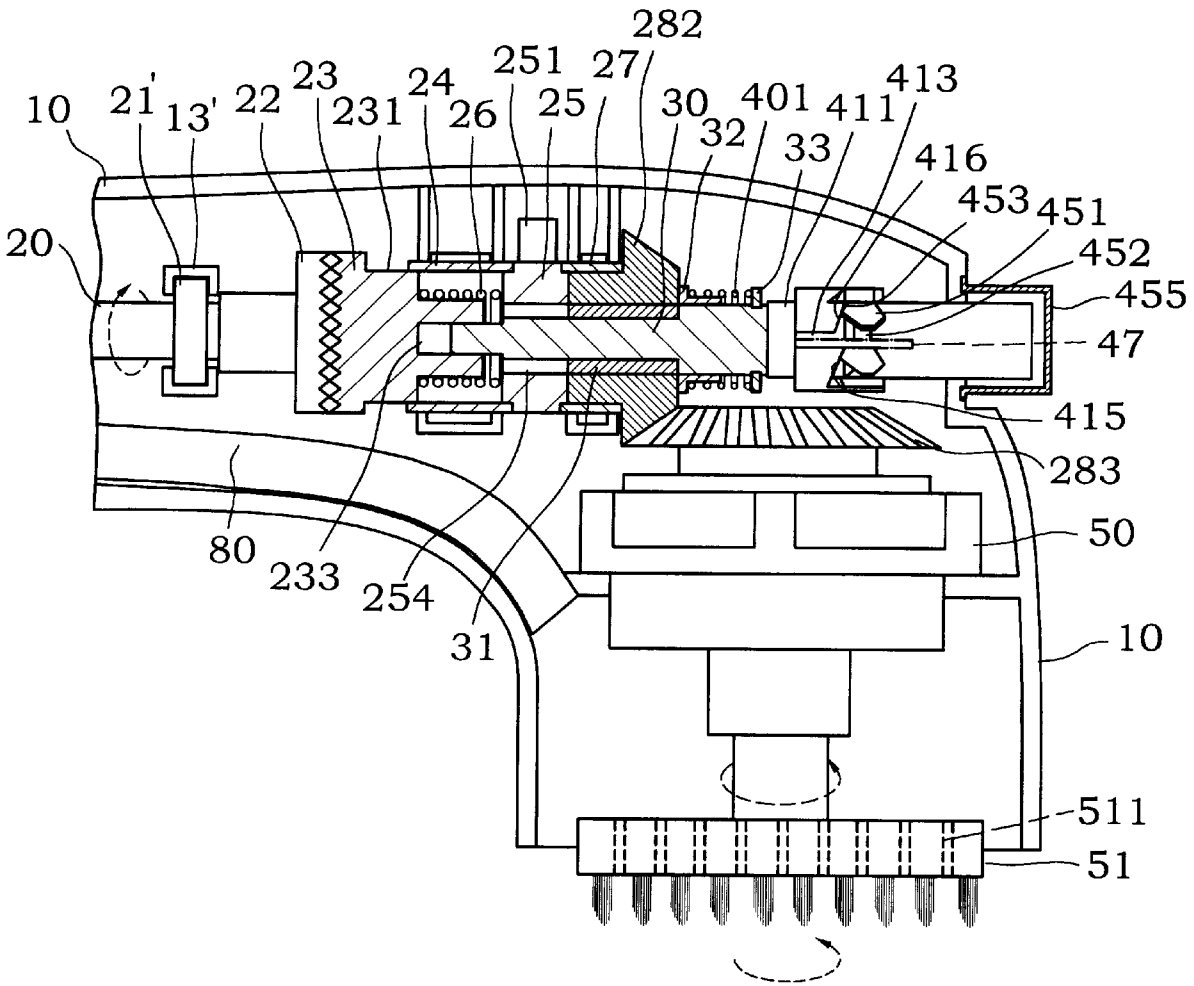
FIG. 8 is partial cross-sectional drawing of the invention herein depicting the shower nozzle spray power.

As indicated in FIG. 8, invention herein has a spray force maintenance device consisting of the driven gear 23 and the packing spring 26. When any component behind the drive gear 22 cannot be impelled, the second transmission shaft 30 is incapable of rotation and pressure is transferred to the said driven gear 23, at which time since the driven gear 23 cannot be smoothly rotated by the drive gear 22, the interlocking enmeshment causes the linear flexile movement of the driven gear 23 inside the first locating ring 24, resulting in the production of an impact sound by the said drive gear 22 that prompts the user of the mechanical problem and that utilization should be stopped.

What is claimed is:

1. A rotating and vibrating massage shower nozzle comprised of:

a first and a second case half that are assembled together to form a hollow containment space and in which a water hose is clamped;

a first transmission shaft situated within the containment space and rotated by a power transfer component;

a drive gear, one end of which is tightly sleeved onto the said first transmission shaft, with the other end consisting of a toothed surface;

a driven gear having a toothed surface at one end that is enmeshed with the toothed surface of the said drive gear;

a bevel gear train consisting of a first gear and a second gear; the said first gear is rotated by the said driven gear and the said second gear is enmeshed to the said first gear and a rotary output coupling, one end of which is connected to the said second gear of the said bevel gear train, with a bathing accessory attached to its other end.

2. The rotating and vibrating massage shower nozzle as claimed in claim 1 wherein said driven gear and said first gear have installed between them a first and a second locating ring that are fitted into the inner walls of said first and second case halves; further comprising shaft sections of said driven gear and said first gear respectively inserted into said first and second locating ring; and the two ends of an eccentric cylinder, consisting of an annular structure having a counterweight lobe disposed on its outer surface and internal splines formed lengthwise along its inside, are respectively inserted into portions of said first and second locating ring.

3. The rotating and vibrating massage shower nozzle as claimed in claim 2 wherein said driven gear and the said eccentric cylinder have a packing spring installed between them.

4. The rotating and vibrating massage shower nozzle as claimed in claim 2 wherein the said first gear and the said eccentric cylinder each have internal splines formed lengthwise along the interior walls of their center shaft holes.

5. The rotating and vibrating massage shower nozzle as claimed in claim 4 wherein the present invention is also comprised of a second transmission shaft, one end of which is inserted through said first gear and said eccentric cylinder, and then snugged into said driven gear; said second transmission shaft is inserted into a drive ring gear and said drive ring gear is enmeshed with said internal splines inside a minimum of one said first gear and said eccentric cylinder.

6. The rotating and vibrating massage shower nozzle as claimed in claim 5 wherein said second transmission shaft has a spring-loaded shifting mechanism disposed at an opposite end section of said second transmission shaft that enables user to flexibly move said second transmission shaft back and forth for massage control.

7. The rotating and vibrating massage shower nozzle as claimed in claim 6 wherein, said spring-loaded shifting mechanism pushes the said second transmission shaft towards said eccentric cylinder such that a section of said drive ring gear is enmeshed with said internal splines of said first gear and another section is enmeshed with said internal splines of said eccentric cylinder.

8. The rotating and vibrating massage shower nozzle as claimed in claim 6 wherein said spring-loaded shifting mechanism pushes said second transmission shaft away from said eccentric cylinder such that said drive ring gear of said second transmission shaft is only engaged with said internal splines of said first gear.

9. The rotating and vibrating massage shower nozzle as claimed in claim 6 wherein said spring-loaded shifting mechanism consists of a spring, a transmission column having two ends and a plunger column; the two ends of the said spring are respectively against a stop collar and a C-shaped clip ring on the said second transmission shaft;

wherein on end of said transmission column provides for insertion into and against the opposite end section of said second transmission shaft, enabling said transmission column to linearly push said second transmission shaft, but remain capable of free rotation; other end of said transmission column is inserted into said plunger column; said transmission column has a plurality of guide slots disposed along its outer periphery, a detent slot of a bevel gear-profiled design situated between each guide slot, a first slanted edge and a second slated edge;

wherein said plunger column is crowned with a plurality of spurs protruding at intervals that correspond to the end section of said transmission column, a guide slot is formed between each spur, and an angular slip actuation edge is disposed on its open end; and wherein said plunger column extends outside said shower nozzle case halves, and wherein said shower nozzle case halves have a plurality of internally protruding slide rails that correspond to said guide slots of said transmission column.

10. The rotating and vibrating massage shower nozzle as claimed in claim 9 wherein a selected portion of said plunger column extending from the said case halves is covered with a soft plastic cap.

11. The rotating and vibrating massage shower nozzle as claimed in claim 9 wherein, when said guide slots of the said transmission column and said plunger column are set onto the said slide rails, said selected portion of said plunger column is pushed out of the said case halves, and said drive ring gear of said second transmission shaft is only engaged with said internal splines of said first gear.

12. The rotating and vibrating massage shower nozzle as claimed in claim 9 wherein said guide slots of said transmission column and said plunger column are set onto said slide rails, said second transmission shaft is pushed towards said eccentric cylinder and said drive ring gear is enmeshed with said internal splines of said first gear and said internal splines of said eccentric cylinder.

13. The rotating and vibrating massage shower nozzle as claimed in claim 1 wherein said first transmission shaft has two bearings utilized for balanced rotation and said bearings are seated inside said first and second case halves.

14. The rotating and vibrating massage shower nozzle as claimed in claim 1 wherein said bathing accessory is a brush head.

15. The rotating and vibrating massage shower nozzle as claimed in claim 1 wherein said bathing accessory is a massage head.

16. The rotating and vibrating massage shower nozzle as claimed in claim 1 wherein said first and a second case halves is sleeved in an elastomeric damper grip.

17. The rotating and vibrating massage shower nozzle as claimed in claim 1 wherein said power transfer component connected to said first transmission shaft is a flexible transmission cable.

* * * * *